US011187410B2

(12) United States Patent
Ewing et al.

(10) Patent No.: US 11,187,410 B2
(45) Date of Patent: Nov. 30, 2021

(54) INTERMITTENT IGNITION DEVICE FOR A FURNACE

(71) Applicant: WINTER IS COMING LLC, Colton, CA (US)

(72) Inventors: Cody Lee Ewing, Floyds Knobs, IN (US); Kenneth Patrick Hobbs, Jr., Louisville, KY (US)

(73) Assignee: WINTER IS COMING LLC, Colton, CA (US)

( * ) Notice: Subject to any disclaimer, the term of this patent is extended or adjusted under 35 U.S.C. 154(b) by 0 days.

(21) Appl. No.: 16/589,761

(22) Filed: Oct. 1, 2019

(65) Prior Publication Data

US 2020/0109855 A1 Apr. 9, 2020

Related U.S. Application Data

(60) Provisional application No. 62/743,140, filed on Oct. 9, 2018.

(51) Int. Cl.
*F23N 5/10* (2006.01)

(52) U.S. Cl.
CPC ..... *F23N 5/105* (2013.01)

(58) Field of Classification Search
CPC ..... F23N 5/105; F24H 3/00
USPC ..... 431/46; 126/116 A, 116 R; 237/53, 48
See application file for complete search history.

(56) References Cited

U.S. PATENT DOCUMENTS 5,293,860 A * 3/1994 Tomlinson ..... F23L 17/00 126/11 OR
2013/0139802 A1* 6/2013 Noman ..... F24H 9/2085 126/11 OR

OTHER PUBLICATIONS

Johnson Controls, G67 Intermittent Pilot Ignition Controls, Technical Bulletin issued Jun. 1998.

* cited by examiner

*Primary Examiner* — Vivek K Shirsat
(74) *Attorney, Agent, or Firm* — Taft Stettinius & Hollister LLP

(57) ABSTRACT

An intermittent ignition device for use with a furnace includes a pilot assembly configured for installation in the furnace and a gas valve configured for installation in the furnace to selectively supply gas to the pilot assembly and a burner assembly of the furnace. The intermittent ignition device further includes an ignition control module that transmits signals to the pilot assembly and the gas valve. The intermittent ignition device further includes a power source positioned outside of the furnace that supplies power to the ignition control module and the gas valve.

7 Claims, 4 Drawing Sheets

INTERMITTENT IGNITION DEVICE FOR A FURNACE

CROSS-REFERENCE TO RELATED APPLICATIONS

The present application claims priority to U.S. Patent Application Ser. No. 62/743,140 filed on Oct. 9, 2018.

BACKGROUND OF THE INVENTION

The present invention relates to an intermittent ignition device for a furnace.

In many furnaces, a standing pilot is used as an ignition source to light a burner when there is a call for heat. Furthermore, the pilot light commonly works in conjunction with a millivolt system to generate sufficient electrical energy to operate the gas valve that controls the supply of gas to the pilot light. Specifically, the pilot light typically heats a thermocouple, which generates sufficient voltage to maintain the valve in an open position. If the pilot light goes out, the gas valve closes.

Such a standing pilot is not particularly efficient, as gas is continually burned while the pilot light is lit. Thus, as an alternative, in intermittent ignition devices, when there is a call for heat, the gas valve releases gas into the pilot and warms a heating element or emits a spark provided by a power source to ignite the gas. The pilot can then be used to light the burner. Once the desired temperature has been reached, the burner and the pilot are extinguished. However, such intermittent ignition devices require a separate power source, as there is no standing pilot that can be used to generate electrical energy for operating the gas valve. In some cases, a battery may be used as a power source, but batteries are often adversely affected by elevated temperatures. Furthermore, a user may encounter hot surfaces accessing the batteries or another power source within a furnace. Therefore, there remains a need for an improved intermittent ignition device for a furnace that addresses and resolves such problems.

SUMMARY OF THE INVENTION

The present invention is an intermittent ignition device for a furnace, and, more particularly, an intermittent ignition device in which the power source provides a spark to ignite the gas is located outside of the primary housing of the furnace.

An exemplary intermittent ignition device for use with a furnace made in accordance with the present invention is generally comprised of: a pilot assembly, including an ignitor and a flame sensor; an ignition control module, which is a microcontroller that receives signals from and transmits control signals to the various components; a gas valve which supplies gas to the pilot assembly and to the burner assembly of the furnace; and a power source that supplies power to the ignition control module and the gas valve.

In use, the ignition control module receive signals from a thermostat representative of a measured temperature. When the measured temperature falls below a predetermined threshold, the ignition control module transmits a control signal to the gas valve to open a pilot portion of the valve to supply gas to the a pilot assembly. The ignition control module also transmits a control signal to the ignitor of the pilot assembly, which creates a spark and lights the pilot. The flame sensor is used to confirm that the pilot has been lit and transmits a signal back to the ignition control module to provide such confirmation. The ignition control module then transmits a control signal to the gas valve to open a main portion of the valve to supply gas to the burner assembly. Once the desired temperature (i.e., the predetermined threshold) as measured by the thermostat has been reached, the ignition control module transmits a control signal to close the gas valve.

A furnace that includes the exemplary intermittent ignition device includes a primary housing, which defines an interior cavity for housing and enclosing the burner assembly and other components of the furnace. The furnace also includes a secondary housing, which defines an interior cavity that is separate and apart from the interior cavity defined by the primary housing. The secondary housing can be characterized as including a mounting plate and a removable cover which fits over and engages the mounting plate, with the mounting plate and the removable cover collectively defining the interior cavity of the secondary housing.

The pilot assembly and the gas valve of the intermittent ignition device are housed and enclosed in the primary housing. However, the ignition control module and the power source of the intermittent ignition device are housed and enclosed in the secondary housing. Thus, the power source can be readily accessed by a user. In other words, the user does not need to access the interior cavity defined by the primary housing or come into contact with the burner assembly or other components of the furnace. Furthermore, the temperature in the secondary housing is significantly less than the temperature within the primary housing when the furnace is on and for a time period thereafter. Thus, the user is unlikely to encounter hot surfaces accessing the power source. Additionally, the ignition control module and the power source are not subjected to the same elevated temperatures as the components in the primary housing, which should prolong the useful life of the power source and/or the ignition control module.

DETAILED DESCRIPTION OF THE INVENTION

The present invention is an intermittent ignition device for a furnace, and, more particularly, an intermittent ignition device in which the power source provides a spark to ignite the gas is located outside of the primary housing of the furnace.

Figure 1:
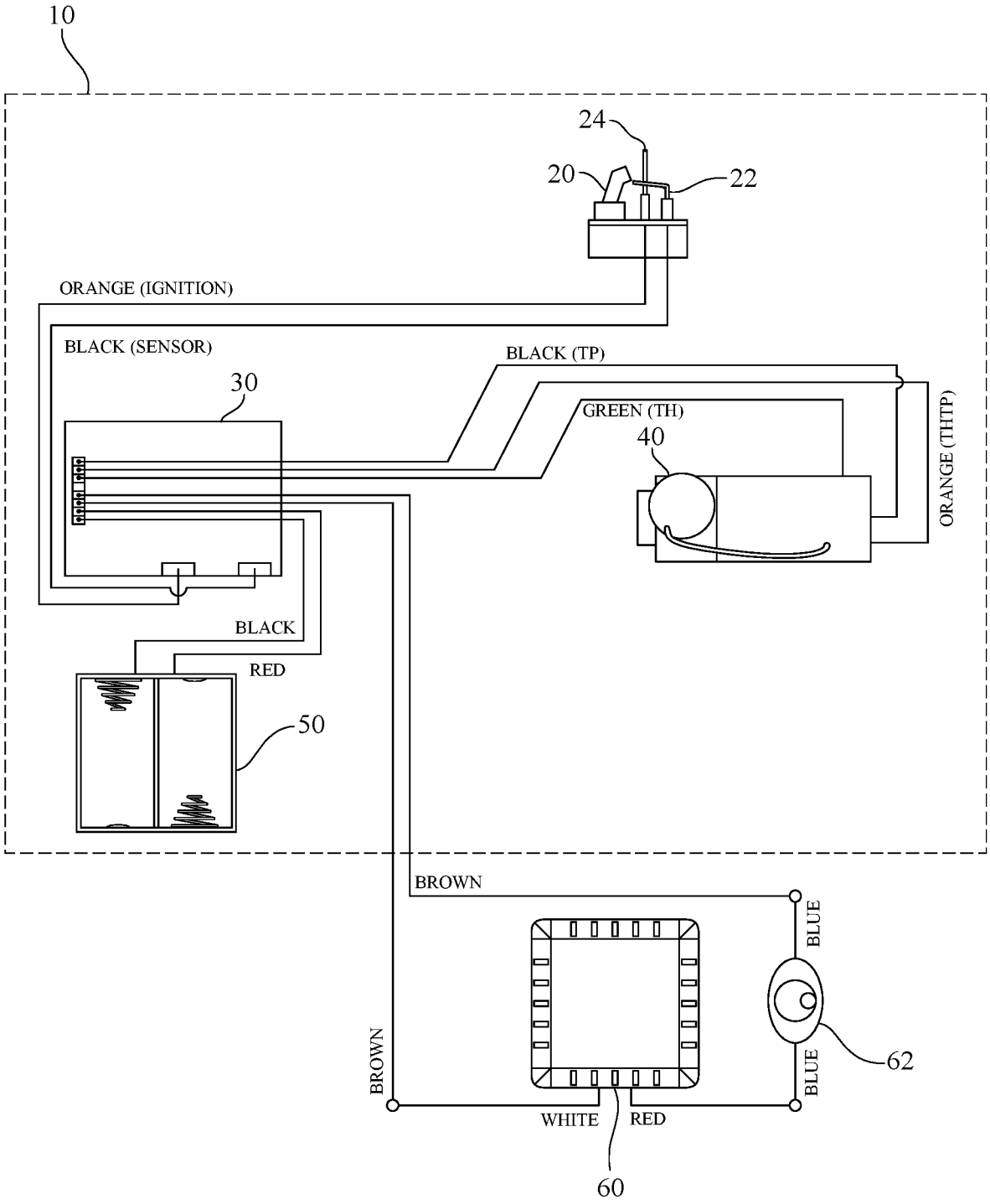
FIG. 1 is a schematic diagram of an exemplary intermittent ignition device for use with a furnace made in accordance with the present invention.

FIG. 1 is a schematic diagram of an exemplary intermittent ignition device 10 for use with a furnace made in accordance with the present invention, and which further illustrates the electrical connections between the various components. As shown in FIG. 1, the intermittent ignition device 10 is generally comprised of: a pilot assembly 20, including an ignitor 22 and a flame sensor 24; an ignition control module 30, which is a microcontroller that receives signals from and transmits control signals to the various components; a gas valve 40 which supplies gas to the pilot assembly 20 and to the burner assembly 80 (see FIG. 4) of the furnace; and a power source 50 that supplies power to the ignition control module 30 and the gas valve 40. Furthermore, as shown in FIG. 1, in this exemplary embodiment, the ignition control module 30 is also operably connected to a thermostat 60 and a safety switch 62.

In use, the ignition control module 30 receive signals from the thermostat 60 representative of a measured temperature. When the measured temperature falls below a predetermined threshold, the ignition control module 30 transmits a control signal to the gas valve 40 to open a pilot portion of the valve 40 to supply gas to the pilot assembly 20. The ignition control module 30 also transmits a control signal to the ignitor 22 of the pilot assembly 20, which creates a spark and lights the pilot. The flame sensor 24 is used to confirm that the pilot has been lit and transmits a signal back to the ignition control module 30 to provide such confirmation. The ignition control module 30 then transmits a control signal to the gas valve 40 to open a main portion of the valve 40 to supply gas to the burner assembly. Once the desired temperature (i.e., the predetermined threshold) as measured by the thermostat 60 has been reached, the ignition control module 30 transmits a control signal to close the gas valve 40.

Figure 2:
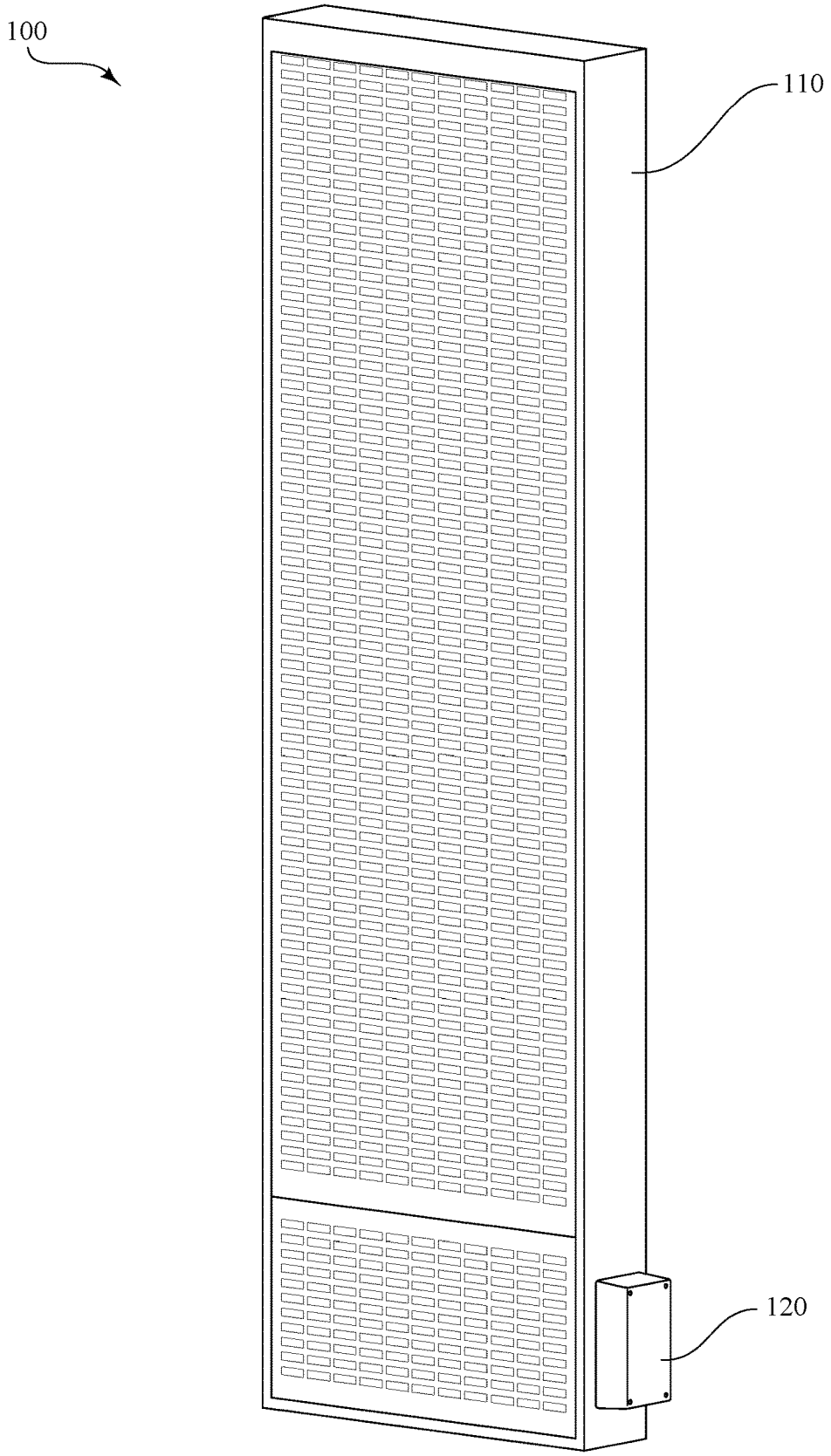
FIG. 2 is perspective view of a furnace that includes an exemplary intermittent ignition device made in accordance with the present invention.

FIG. 2 is perspective view of a furnace 100 that includes the exemplary intermittent ignition device 10 described above. As shown, the furnace 100 includes a primary housing 110, which defines an interior cavity for housing and enclosing the burner assembly 80 and other components of the furnace 100. As shown, the furnace 100 also includes a secondary housing 120, which is mounted to an external surface of the primary housing 110. The secondary housing 120 defines an interior cavity that is separate and apart from the interior cavity defined by the primary housing 110, as further described below.

Figure 3:
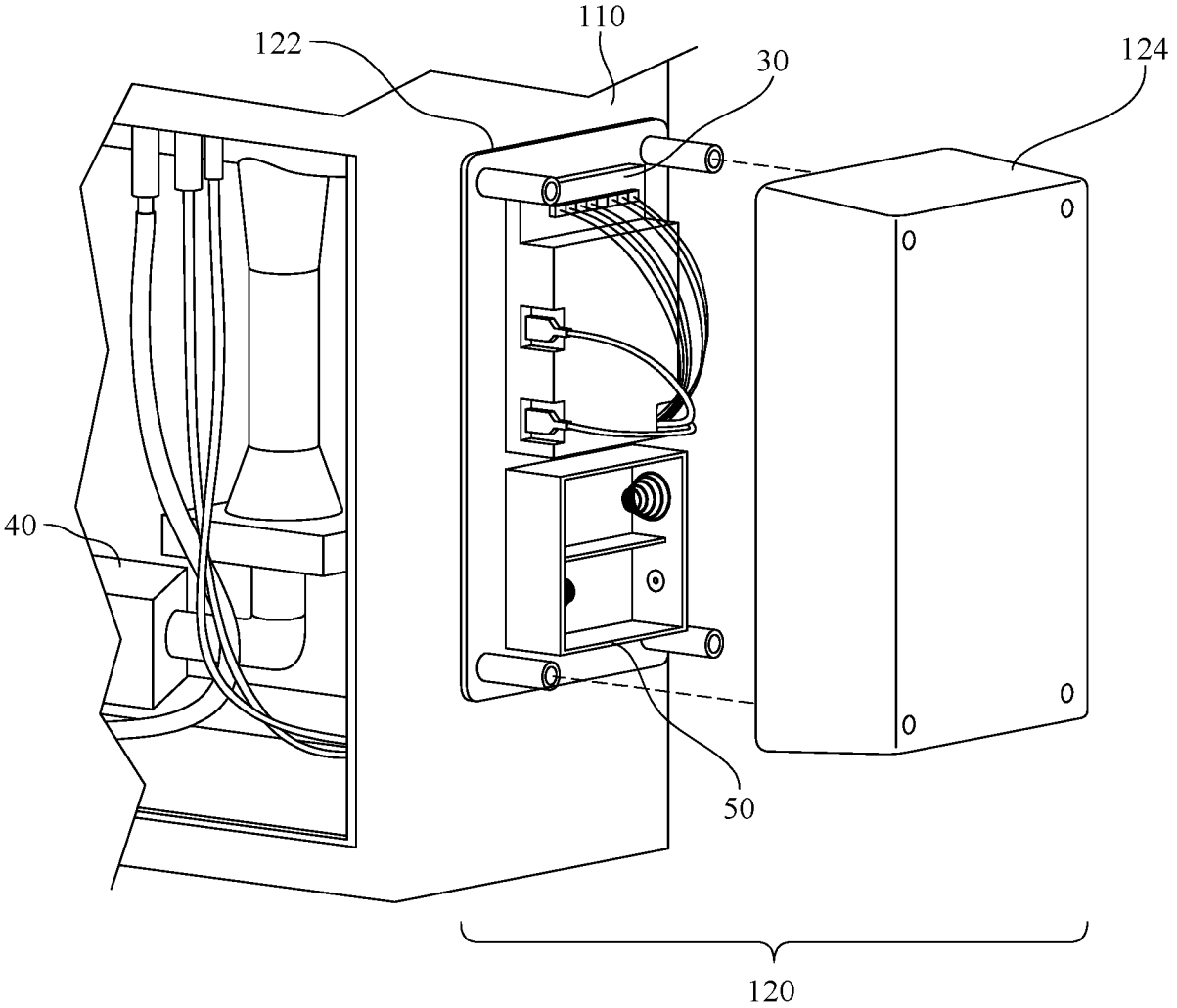
FIG. 3 is an enlarged partial perspective view of a bottom portion of the furnace of FIG. 2, including the secondary housing.

FIG. 3 is an enlarged partial perspective view of a bottom portion of the furnace 100 and the secondary housing 120, in which the cover 124 has been removed. As shown, in this exemplary embodiment, the secondary housing 120 can be characterized as including a mounting plate 122 and the removable cover 124 which fits over and engages the mounting plate 122, with the mounting plate and the removable cover 124 collectively defining the interior cavity of the secondary housing 120. In this exemplary embodiment, as mentioned above, the mounting plate 122 is secured to an external surface of the primary housing 110, but, in other implementations, it could be secured to a wall surface separate and apart from the primary housing 110 without departing from the spirit and scope of the present invention.

Figure 4:
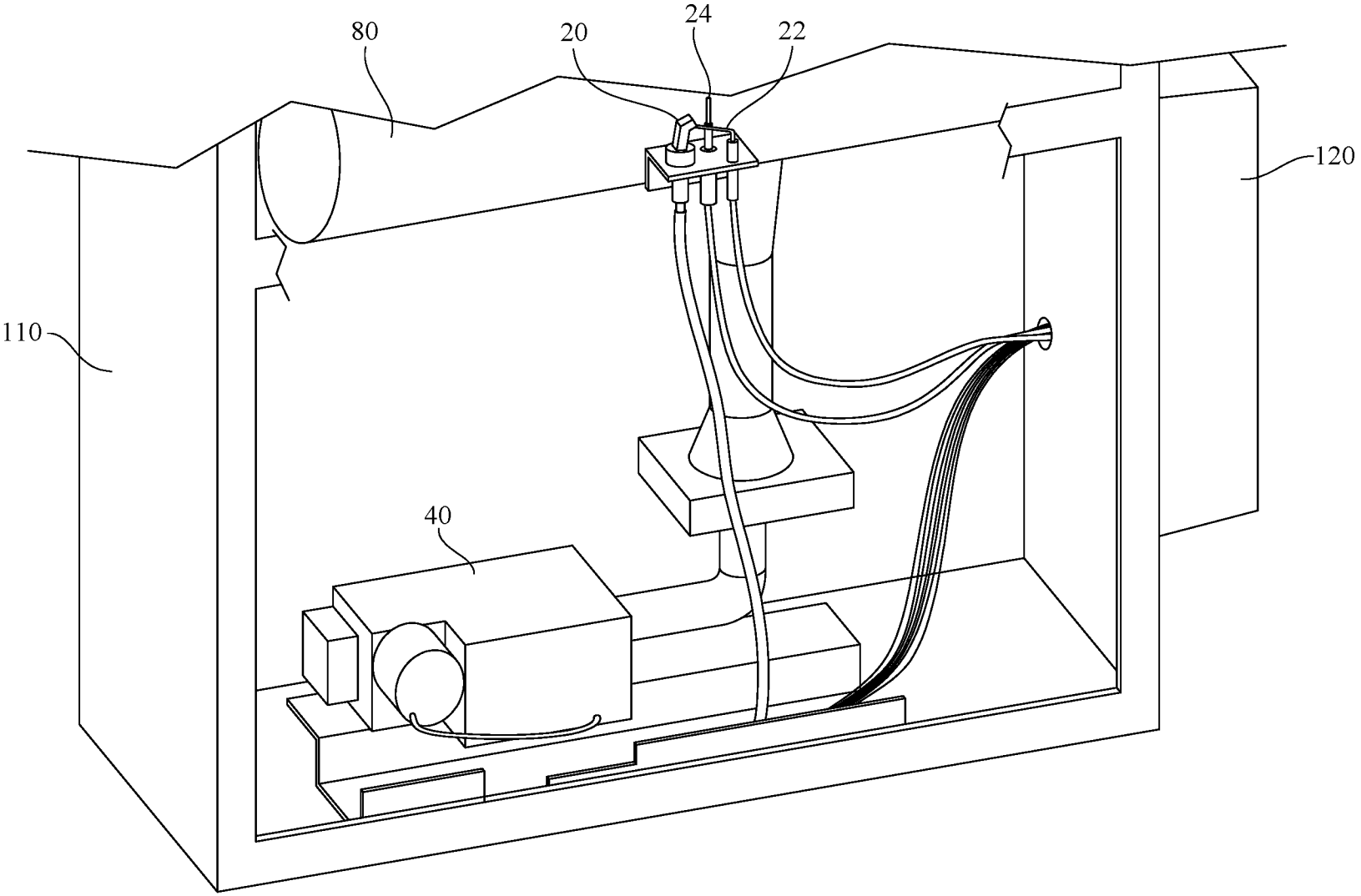
FIG. 4 is an enlarged partial perspective view of a bottom portion of the furnace of FIG. 2, in which a lower access panel has been removed.

FIG. 4 is an enlarged partial perspective view of a bottom portion of the furnace 100, in which a lower access panel has been removed to illustrate the interior of the primary housing 110.

Referring now to FIGS. 1-4, the pilot assembly 20 and the gas valve 40 of the intermittent ignition device 10 are also housed and enclosed in the primary housing 110. However, the ignition control module 30 and the power source 50 of the intermittent ignition device 10 are housed and enclosed in the secondary housing 120. Thus, the power source 50 can be readily accessed by a user simply by removing the cover 124 of the secondary housing 120. In other words, the user does not need to access the interior cavity defined by the primary housing 110 or come into contact with the burner assembly 80 or other components of the furnace. Furthermore, the temperature in the secondary housing 120 is significantly less than the temperature within the primary housing 110 when the furnace is on and for a time period thereafter. Thus, the user is unlikely to encounter hot surfaces accessing the power source 50. Additionally, the ignition control module 30 and the power source 50 are not subjected to the same elevated temperatures as the components in the primary housing 110, which should prolong the useful life of the power source 50 and/or the ignition control module 30.

Referring now to FIGS. 2-4, as shown, in this exemplary embodiment, the power source 50 is in the form of a battery pack that can accommodate two standard D-cell batteries. Of course, other forms of batteries or power sources could also be used in the intermittent ignition device 10 without departing from the spirit and scope of the present invention. However, batteries are commonly available, and, because the power source 50 can be readily accessed by a user simply by removing the cover 124 of the secondary housing 120, batteries can be easily removed and replaced at any time.

One of ordinary skill in the art will also recognize that additional embodiments are also possible without departing from the teachings of the present invention. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. An intermittent ignition device for use with a furnace, comprising:

a pilot assembly configured for installation in a primary housing defining a first interior cavity of the furnace;

a gas valve configured for installation in the first interior cavity of the furnace to selectively supply gas to the pilot assembly and a burner assembly of the furnace;

an ignition control module enclosed in a secondary housing of the furnace defining a second interior cavity separate and apart from the first interior cavity, wherein the ignition control module transmits signals to the pilot assembly and the gas valve; and a power source configured for placement in the second interior cavity that supplies power to the ignition control module and the gas valve.

2. The intermittent ignition device as recited in claim 1, wherein the power source is a battery pack.

3. A furnace, comprising:

a primary housing defining a first interior cavity;

a burner assembly housed and enclosed in the first interior cavity defined by the primary housing;

a secondary housing defining a second interior cavity separate and apart from the first interior cavity defined by the primary housing; and an intermittent ignition device, including a pilot assembly positioned in the first interior cavity, a gas valve positioned in the first interior cavity and configured to selectively supply gas to the pilot assembly and the burner assembly, an ignition control module enclosed in the second interior cavity that transmits control signals to the pilot assembly and the gas valve, and a power source positioned in the second interior cavity that supplies power to the ignition control module and the gas valve.

4. The furnace as recited in claim 3, wherein the secondary housing is mounted to an external surface of the primary housing.

5. The furnace as recited in claim 3, wherein the secondary housing includes a mounting plate and a removable cover which fits over and engages the mounting plate.

6. The furnace as recited in claim 5, wherein the mounting plate is mounted to an external surface of the primary housing.

7. The furnace as recited in claim 3, wherein the power source is a battery pack.

* * * * *